US012734457B2

(12) United States Patent
Chen

(10) Patent No.: US 12,734,457 B2
(45) Date of Patent: Sep. 15, 2026

(54) TOY FOR MAKING BIND-UP MEMBER

(71) Applicant: Shantou Weiqi Fairy Tale Trade Co., LTD, Shantou (CN)

(72) Inventor: Mubiao Chen, Shantou (CN)

(73) Assignee: Shantou Weiqi Fairy Tale Trade Co., LTD, Shantou (CN)

( * ) Notice: Subject to any disclaimer, the term of this patent is extended or adjusted under 35 U.S.C. 154(b) by 181 days.

(21) Appl. No.: 18/793,819

(22) Filed: Aug. 4, 2024

(65) Prior Publication Data

US 2024/0390813 A1 Nov. 28, 2024

(30) Foreign Application Priority Data

Mar. 27, 2024 (CN) ..... 202420602860.1

(51) Int. Cl.
*A63H 33/00* (2006.01)

(52) U.S. Cl.
CPC ..... *A63H 33/00* (2013.01)

(58) Field of Classification Search
CPC ..... A63H 33/00; A44C 27/00; A45D 8/006
See application file for complete search history.

(56) References Cited

U.S. PATENT DOCUMENTS 5,890,497 A * 4/1999 Tsai ..... A44B 11/266 24/615
5,913,319 A * 6/1999 Tsai ..... A45D 8/34 132/273
8,943,694 B2 * 2/2015 Kobayashi ..... B44C 5/00 132/273
2004/0149305 A1 * 8/2004 Tsai ..... A45D 8/34 132/273
2010/0041305 A1 2/2010 O'Connor
2011/0048450 A1 * 3/2011 Tsai ..... A45D 8/34 132/273
2011/0168746 A1 * 7/2011 Kamiyama ..... D04D 11/00 223/48
2016/0292562 A1 10/2016 Ashida et al.
2017/0028309 A1 2/2017 Aizato et al.
2018/0125182 A1 * 5/2018 Barouch ..... D04D 1/04
2018/0354740 A1 * 12/2018 Elliott ..... B65H 35/0086

FOREIGN PATENT DOCUMENTS

CN 203154832 U * 8/2013
CN 115177960 A * 10/2022 ..... A63H 33/00
CN 219762658 U * 9/2023 ..... A44C 17/0208
CN 223403406 U * 10/2025
DE 20214199 U1 * 11/2002 ..... A45D 8/006

(Continued)

*Primary Examiner* — Christine M Mills
(74) *Attorney, Agent, or Firm* — Hemisphere Law, PLLC

(57) ABSTRACT

The present disclosure discloses a toy for making a bind-up member, including a seat body, a main body, an elastic member, and a connection assembly; the main body is arranged on the seat body; the main body is shaped like a non-closed ring, and a limiting structure is arranged on an outer circumferential wall of the main body; the elastic member is arranged around the outer circumferential wall of the main body by means of the limiting structure; the elastic member has a first end portion and a second end portion, The toy is convenient to use and improves the operational ability of children; and the product is more educational and beautiful.

10 Claims, 8 Drawing Sheets

(56) References Cited

FOREIGN PATENT DOCUMENTS

| | | | | | |
|---|---|---|---|---|---|
| JP | H07150453 | A | * | 6/1995 | |
| JP | H09121928 | A | * | 5/1997 | |
| JP | 2004041309 | A | * | 2/2004 | |
| JP | 2016214354 | A | * | 12/2016 | |
| JP | 2021083495 | A | * | 6/2021 | |
| KR | 200371061 | Y1 | * | 12/2004 | ..... A45D 8/34 |
| KR | 101747036 | B1 | * | 6/2017 | ..... D04D 9/00 |
| KR | 102660808 | B1 | * | 4/2024 | ..... A45D 8/36 |
| TR | 2023020057 | U4 | * | 7/2025 | |
| WO | WO-2025211156 | A1 | * | 10/2025 | ..... A63H 33/00 |

* cited by examiner

TOY FOR MAKING BIND-UP MEMBER

TECHNICAL FIELD

The present disclosure relates to the technical field of toys, and more particularly, to a toy for making a bind-up member.

BACKGROUND

Toys are usually used as items for daily entertainment of people. Especially for children, various novel functional toys are constantly emerging, which not only enhance the cognitive competence of children in life, but also indirectly improve the operational ability of children through connection, assembling, and disassembling of toys, thereby increasing the sales of educational toys on the market every day.

In the educational toys, a hair tie toy is usually of a circular closed-ring structure made of a rubber material, to tie the hairs. When children play, due to the curiosity, the hair tie toy is easily broken by pulling. Therefore, a tie body that has been broken or is not formed into a ring easily causes a waste of resources, and the tie body cannot be used.

SUMMARY

Based on this, it is necessary to provide a toy for making a bind-up member for the above problem. By the toy, a tie body that is not formed into a ring can be continued to be used, so that the waste of resources is improved. Furthermore, the product has the advantages of facilitating use and improving the operational ability of children.

The toy for making a bind-up member provided by the present disclosure includes:

a seat body, provided with a load-bearing surface;

a main body, shaped like a non-closed ring, wherein the main body is suspended on the load-bearing surface, and a limiting structure is arranged on an outer circumferential wall of the main body;

an elastic member, arranged around the outer circumferential wall of the main body by means of the limiting structure, wherein the elastic member is provided with a first end portion that can extend from a first end of the main body, and a second portion that extends from a second end of the main body; and a connection assembly, including a first cover body that is detachably mounted on the load-bearing surface, and a second cover body that is detachably connected to the first cover body, wherein the first cover body is provided with a limiting slot, a first channel, and a second channel; the first channel penetrates through one side wall of the limiting slot and is communicated to the limiting slot; the second channel penetrates through another side wall of the limiting slot and is communicated to the limiting slot;

the connection assembly has a first state in which the first cover body and the second cover body are separated, and a second state in which the first cover body and the second cover body are connected;

in the first state, the first end portion can enter the limiting slot via the first channel, and the second end portion can enter the limiting slot via the second channel; in the second state, the second cover body covers a notch of the limiting slot; and both the first end portion and the second end portion can be limited between the first cover body and the second cover body.

In an embodiment, the toy for making the bind-up member further includes a decorative part, and the decorative part sleeves the elastic member.

In an embodiment, a material of the decorative part is lace, silk, fur, or cloth.

In an embodiment, a cross-sectional area of the first channel is smaller than a cross-sectional area of the limiting slot; a cross-sectional area of the second channel is smaller than the cross-sectional area of the limiting slot;

the first end and the second end of the main body define a gap; the first cover body is correspondingly arranged at the gap;

the main body further includes a supporting member, and the first end of the main body is connected to the load-bearing surface through the supporting member;

the toy for making the bind-up member further includes a supporting seat arranged on the load-bearing surface; a mounting slot is arranged on the supporting seat; and the first cover body is detachably mounted in the mounting slot.

In an embodiment, the limiting structure is constructed as a groove provided on the outer circumferential wall of the main body.

In an embodiment, the limiting structure extends from the first end of the main body to the second end of the main body along the outer circumferential wall of the main body.

In an embodiment, the limiting structure includes a first portion located at the first end of the main body, a second portion located at the second end of the main body, and a third portion connected to the first portion and the second portion; and a cross-sectional area of the first portion and a cross-sectional area of the second portion are both smaller than a cross-sectional area of the third portion.

In an embodiment, the seat body includes:

a shell, provided with an accommodating chamber and a mounting opening communicated to the accommodating chamber;

a load-bearing member, covering the mounting opening, wherein a surface of one side of the load-bearing member facing away from the accommodating chamber is the load-bearing surface; the load-bearing member is provided with a sound hole; and a sound production unit, a power supply, a light emitting unit, and a control unit which are all arranged in the accommodating chamber, wherein the control unit is electrically connected to the sound production unit, the light emitting unit, and the power supply, respectively.

In an embodiment, the toy for making the bind-up member further includes a cover; the cover is rotatably connected to the seat body; and the cover can cover the load-bearing surface.

In an embodiment, the cover includes a cover main body rotatably connected to the seat body and capable of covering the load-bearing surface, and a handle detachably connected to the cover main body.

In the embodiments of the present disclosure, the toy includes the seat body, the main body, the elastic member, and the connection assembly. The main body is arranged on the seat body; the main body is shaped like the non-closed ring, and the limiting structure is arranged on the outer circumferential wall; the elastic member is arranged around the outer circumferential wall of the main body by means of the limiting structure; the two end portions of the elastic member are arranged at the connection assembly through the limiting structure; and the connection assembly is detachably connected to the seat body. Thus, the elastic member and the connection assembly are connected into a bind-up ringlike structural member, which reduces the waste of resources or avoids that a tie body cannot be used.

DESCRIPTIONS OF REFERENCE NUMERALS

Figure 1:
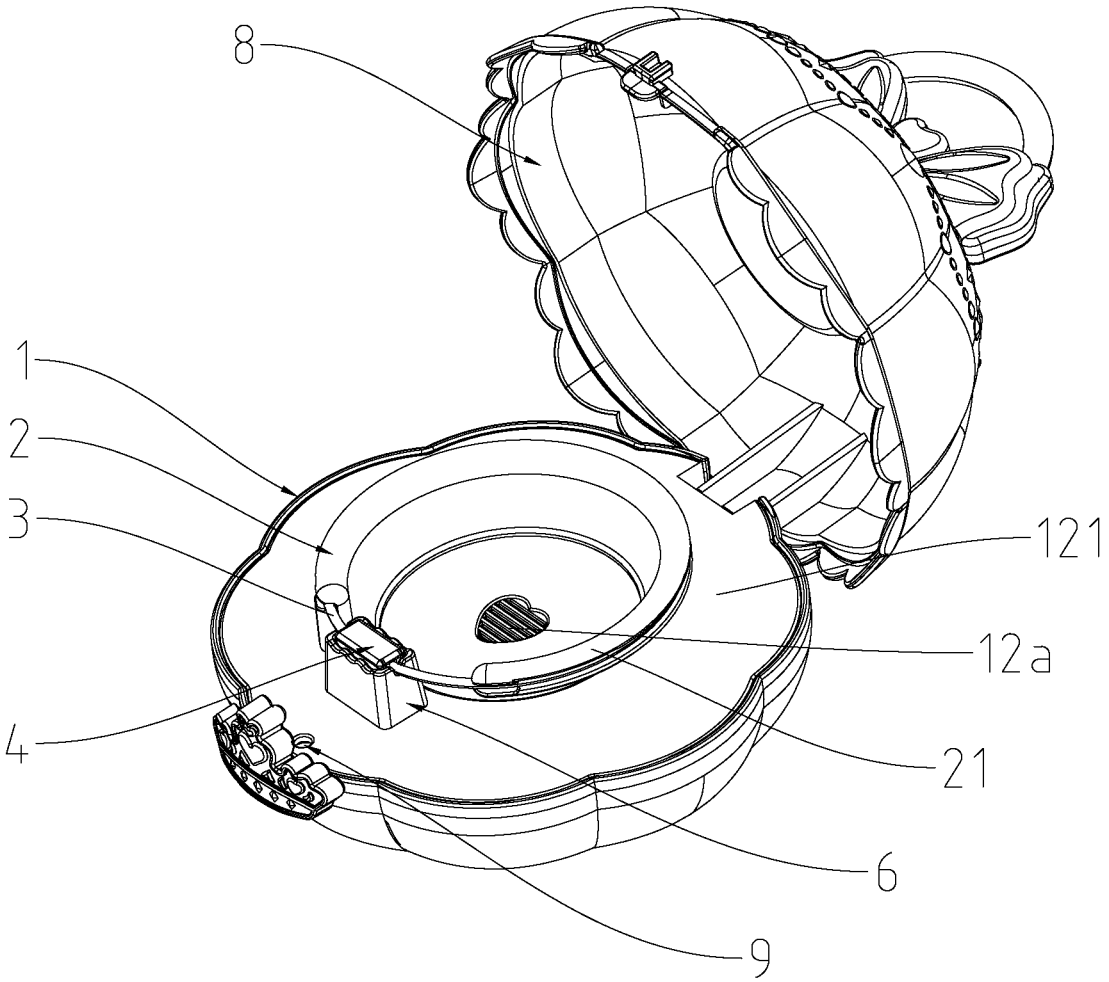
FIG. 1 is a schematic structural diagram of opening of a toy according to an embodiment of the present disclosure.

1: seat body; 11: shell; 11*a*: accommodating chamber; 11*b*: mounting opening; 12: load-bearing member; 12*a*: sound hole; 121: load-bearing surface;

2: main body; 21: ring; 22: supporting member; 2*a*: limiting structure; 21*a*: first portion; 21*b*: second portion; 21*c*: third portion; 2*b*: gap;

3: elastic member; 31: first end portion; 32: second end portion;

4: connection assembly; 41: first cover body; 411: clamping recess; 42: second cover body; 421: clamping protrusion; 41*a*: first channel; 41*b*: second channel; 41*c*: limiting slot;

5: decorative part; 5*a*: decorative hole;

6: supporting seat; 6*a*: mounting slot; 6*b*: third channel; 6*c*: second channel;

7: control system; 71: sound production unit; 72: light emitting unit; 73: control unit; 74: power supply;

8: cover; 81: cover main body; 82: handle; 81*a*: storage chamber; 811: first contact portion; 822: second contact portion; and

9: switching portion.

DETAILED DESCRIPTION OF THE EMBODIMENTS

In order to make the aforementioned objectives, features, and advantages of the present disclosure more comprehensible, specific implementations of the present disclosure are described in detail below in conjunction with the accompanying drawings. In the following description, numerous specific details are set forth in order to provide a thorough understanding of the present disclosure. The present disclosure may, however, be embodied in many forms different from that described here. A person skilled in the art can make similar improvements without departing from the connotation of the present disclosure. Therefore, the present disclosure is not limited by the specific embodiments disclosed below.

In the descriptions of the present disclosure, it should be understood that if the following terms appear: "center", "longitudinal", "transverse", "length", "width", "thickness", "upper", "lower", "front", "rear", "left", "right", "vertical", "horizontal", "top", "bottom", "inner", "outer", "clockwise", "anticlockwise", "axial", "radial", "circumferential" and the like, orientations or positional relationships indicated by these terms are orientations or positional relationships as shown in the drawings, and are only for the purpose of facilitating and simplifying the descriptions of the present disclosure instead of indicating or implying that devices or elements indicated must have particular orientations, and be constructed and operated in the particular orientations, so that these terms are not construed as limiting the present disclosure.

In addition, if the following terms appear: "first" and "second", these terms are used for descriptive purposes only and are not to be construed as indicating or implying relative importance or to implicitly indicate the number of technical features indicated. From this, features defined as "first" and "second" may explicitly or implicitly include at least one feature. In the description of the present disclosure, if the term "plurality" appears, "plurality" means at least two, for example, two and three, unless explicitly specified otherwise.

In the present disclosure, unless otherwise expressly specified and limited, if terms "mount", "connect", "connection", "fix", and the like appear, these terms should be understood broadly. For example, it may be a fixed connection, a detachable connection, an integrated connection, a mechanical connection, an electrical connection, a direct connection, an indirect connection through an intermediate medium, an internal communication of two elements, or interaction between two elements, unless expressly specified otherwise. Those of ordinary skill in the art can understand the specific meanings of the above terms in this application according to specific situations.

In the present disclosure, unless otherwise expressly specified and limited, if there is a description that a first feature is "above" or "below" a second feature, it may means that the first feature and the second feature are in direct contact, or the first feature and the second feature are in indirect contact through an intermediate. In addition, that the first feature is "on", "above", or "over" the second feature may include that the first feature is directly or diagonally above the second feature or merely indicates that a level of the first feature is higher than that of the second feature. The first feature "below", "beneath", and "under" of the second feature can indicate that the first feature is directly or diagonally below the second feature, or merely indicates that a level of the first feature is less than that of the second feature.

It should be noted that if an element is referred to as being "fixed to" or "arranged to" another element, the element can be directly on another component or there can be a centered element. When an element is considered to be "connected" to another element, the element can be directly connected to another element or there may be a centered element. If any, terms "vertical", "horizontal", "up", "down", "left", "right", and similar expressions used herein are for illustrative purposes only and do not necessarily represent the only implementation.

The present disclosure will be explained below in detail in conjunction with the accompanying drawings.

The inventor of the present disclosure has found that in the field of toys, a hair tie toy is usually of a circular closed-ring structure made of a rubber material, to tie the hairs. When children play, due to the curiosity, the hair tie toy is easily broken by pulling. Therefore, a tie body that has been broken or is not formed into a ring easily causes a waste of resources, and the tie body cannot be used.

Based on this, the inventor has also found that hair bands are usually hair tie matching decorative parts, which are usually aesthetically pleasing. The decorative part can be made of lace, silk, fur, cloth and other materials. One of the problems needing to be solved by the inventor is how to make a tie matching decorative part become a hair band. The solution to this problem not only improves the operational ability of children, but also indirectly beautifies the overall appearance of the product.

To solve the above problems, reduce the waste of resources or avoid that a tie body cannot be used, improve the operational ability of children, and beautify the overall appearance of the product, the inventor of the present disclosure has developed and researched relevant structures.

In the present disclosure, as shown in FIG. 1, a toy for making a bind-up member provided by the present disclosure includes: a seat body 1, a main body 2, elastic member 3, and connection assembly 4. The seat body 1 has a load-bearing surface 121. The main body 2 is set as an unclosed ring 21. The unclosed ring 21 can be an incomplete circle or an unclosed ring structure.

As shown in FIG. 1 to FIG. 6, the main body 2 is suspended on the load-bearing surface 121. It can be understood that the main body 2 can be connected to the load-bearing surface 121 through a column, a supporting frame, or a connection seat, so that the main body 2 is arranged on the load-bearing surface 121 without being in contact with the load-bearing surface 121. A limiting structure 2*a* is arranged on an outer circumferential wall of the main body 2. The limiting structure 2*a* can be a mechanical limit, a groove, a clamp, a baffle plate, or the like, and has a function of limitation.

As shown in FIG. 1 to FIG. 6, the elastic member 3 is arranged around the outer circumferential wall of the main body 2 by means of the limiting structure 2*a*. It can be understood that the elastic member 3 can be an elastic webbing, a rubber band, a rubber belt, an elastic rope, or other elastic members. The elastic member 3 can extend out of a first end portion 31 of one end of the main body 2, and can extend out of a second end portion 32 of the other end of the main body 2. The first end portion 31 is not connected to the second end portion 32, and cross-sectional areas of both the first end portion 31 and the second end portion 32 can be larger than that of the limiting structure 2*a*. The elastic member 3 surrounds and is arranged on the main body 2 along the limiting structure 2*a*, so as to control the elastic member 3 by the limiting structure 2*a*, so that the elastic member 3 is not easily elastically retracted and moved.

Figure 3:
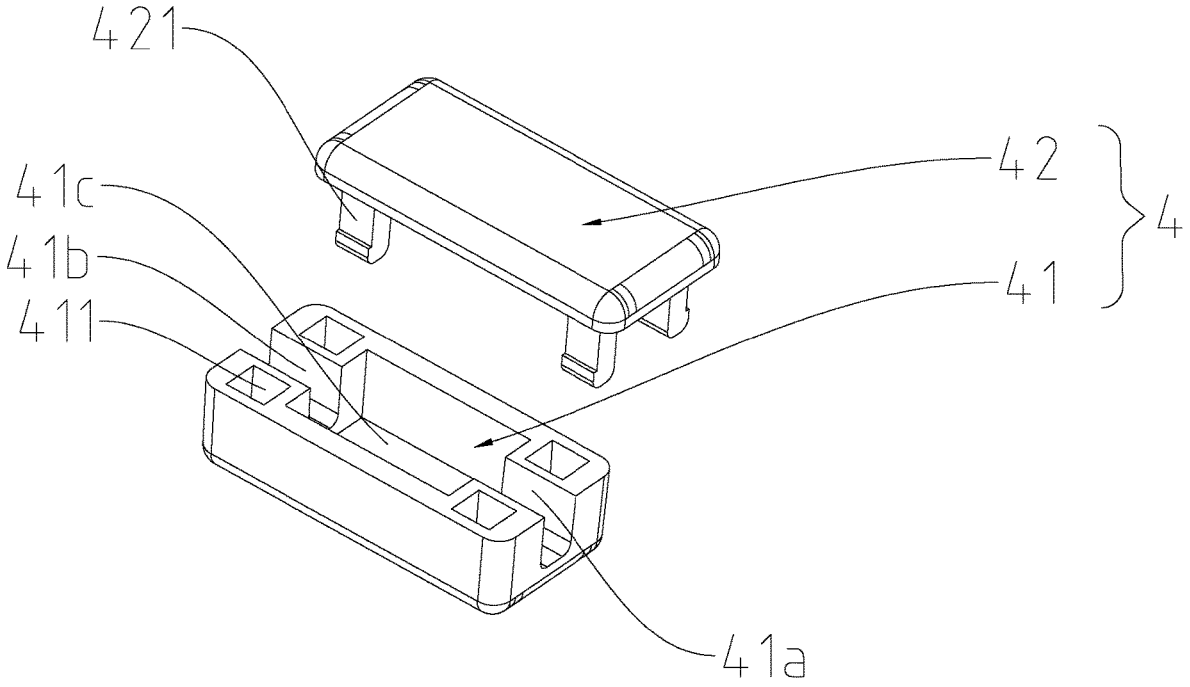
FIG. 3 is a schematic structural diagram of a connection assembly in a first state in an embodiment of the present disclosure.

As shown in FIG. 1 and FIG. 3, the connection assembly 4 includes a first cover body 41 that is detachably mounted on the load-bearing surface 121, and a second cover body 42 that is detachably connected to the first cover body 41. The first cover body 41 is provided with a limiting slot 41*c*, a first channel 41*a*, and a second channel 41*b*; the first channel 41*a* penetrates through one side wall of the limiting slot 41*c* and is communicated to the limiting slot 41*c*; the second channel 41*b* penetrates through the other side wall of the limiting slot 41*c* and is communicated to the limiting slot 41*c*. It can be understood that the first cover body 41 can be a base, a fixed seat, or a load-bearing seat, and the detachable or detachable connection can be threaded connection, buckle connection, or pin connection. The second cover body 42 can be a cover, a sealing plate, or a sealing member. The limiting slot 41*c* is communicated to the first channel 41*a* and the second channel 41*b*, and a cross-sectional area of the limiting slot 41*c* is larger than those of the first end portion 31 and the second end portion 32, so as to facilitate the elastic member 3 to pass through the first channel 41*a* and the second channel 41*b* and be arranged in the limiting slot 41*c*, playing an accommodating and limiting effect.

Figure 4:
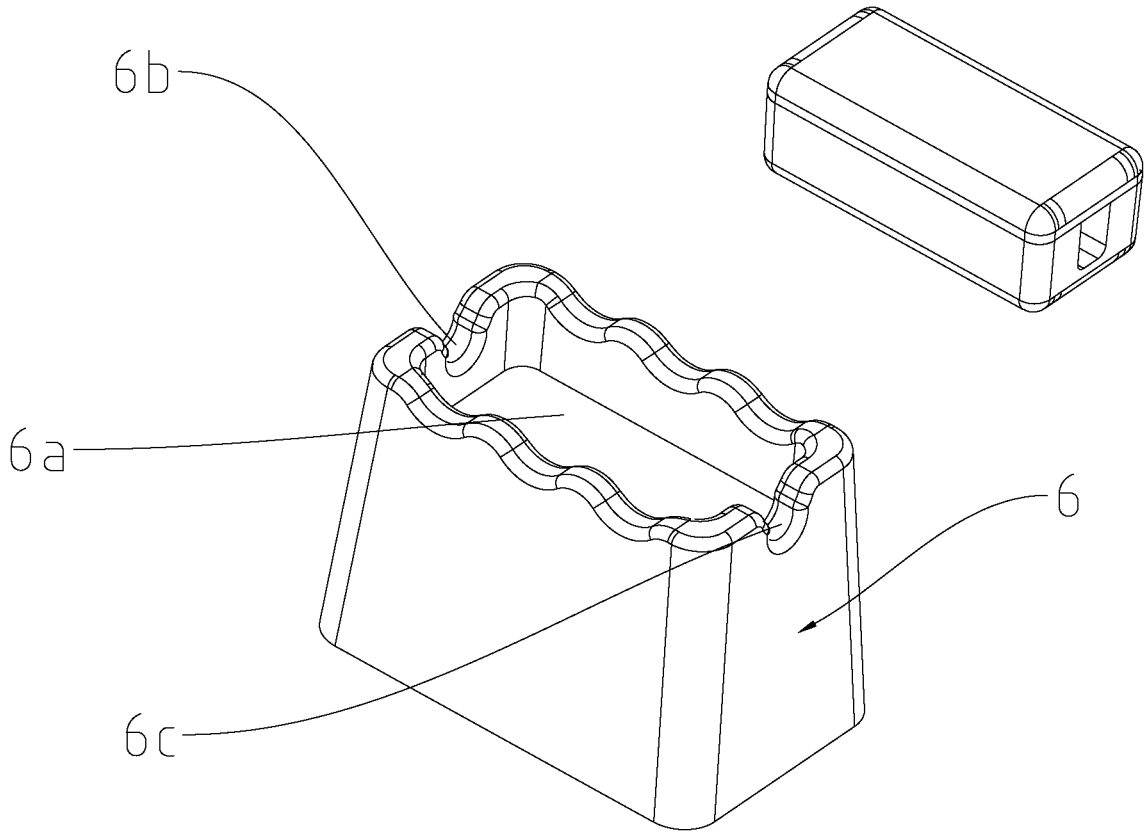
FIG. 4 is a schematic structural diagram of a connection assembly in a second state in an embodiment of the present disclosure.

As shown in FIG. 3, the connection assembly 4 has a first state in which the first cover body 41 and the second cover body 42 are separated. As shown in FIG. 4, the connection assembly 4 has a second state in which the first cover body 41 and the second cover body 42 are connected.

The first cover body 41 is provided with a clamping recess 411, and the second cover body 42 is provided with a clamping protrusion 421. The clamping recess 411 is in clamping fit with the clamping protrusion 421.

Figure 2:
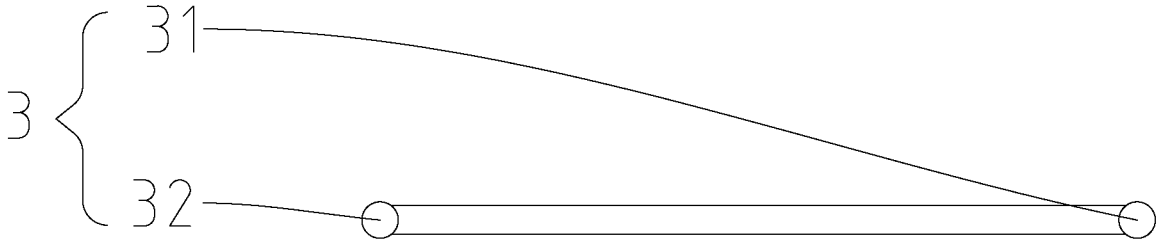
FIG. 2 is a schematic structural diagram of an elastic member in an embodiment of the present disclosure.

As shown in FIG. 1 to FIG. 3, in the first state, the first end portion 31 can enter the limiting slot 41*c* through the first channel 41*a*, and the second end portion 32 can enter the limiting slot 41*c* through the second channel 41*b*. It can be understood that in the first state, the first cover body 41 and the second cover body 42 are separated, and the first end portion 31 and the second end portion 32 enter the limiting slot 41*c*. In the second state, the second cover body 42 covers a notch of the limiting slot 41*c*, and both the first end portion 31 and the second end portion 32 can be limited between the first cover body 41 and the second cover body 42. In the second state, the second cover body 42 cooperates with the first cover body 41 to achieve an effect of limiting the first end portion 31 and the second end portion 32 and fixing the first end portion in the first cover body 41. Thus, the elastic member 3 is arranged around the limiting structure 2*a* on the main body 2; the two end portions of the elastic member 3 are arranged in the limiting slot 41*c* of the first cover body 41 through the first channel 41*a* and the second channel 41*b*, which can prevent the elastic member 3 from retracting. The first end portion 31 and the second end portion 32 of the elastic member 3 can be fixed in the limiting slot 41*c* due to the limitation of the limiting slot 41*c*. The second cover body 42 is clamped to the first cover body 41, making it difficult to separate the connection assembly 4. Therefore, the elastic member 3 can cooperate with the connection assembly 4 to form an elastic hair tie. This not only reduces the waste of resources or avoids that a tie body cannot be used, but also improves the operational ability of a user.

In some embodiments, the toy for making the bind-up member further includes a decorative part 5, and the decorative part 5 sleeves the elastic member 3.

Figure 5:
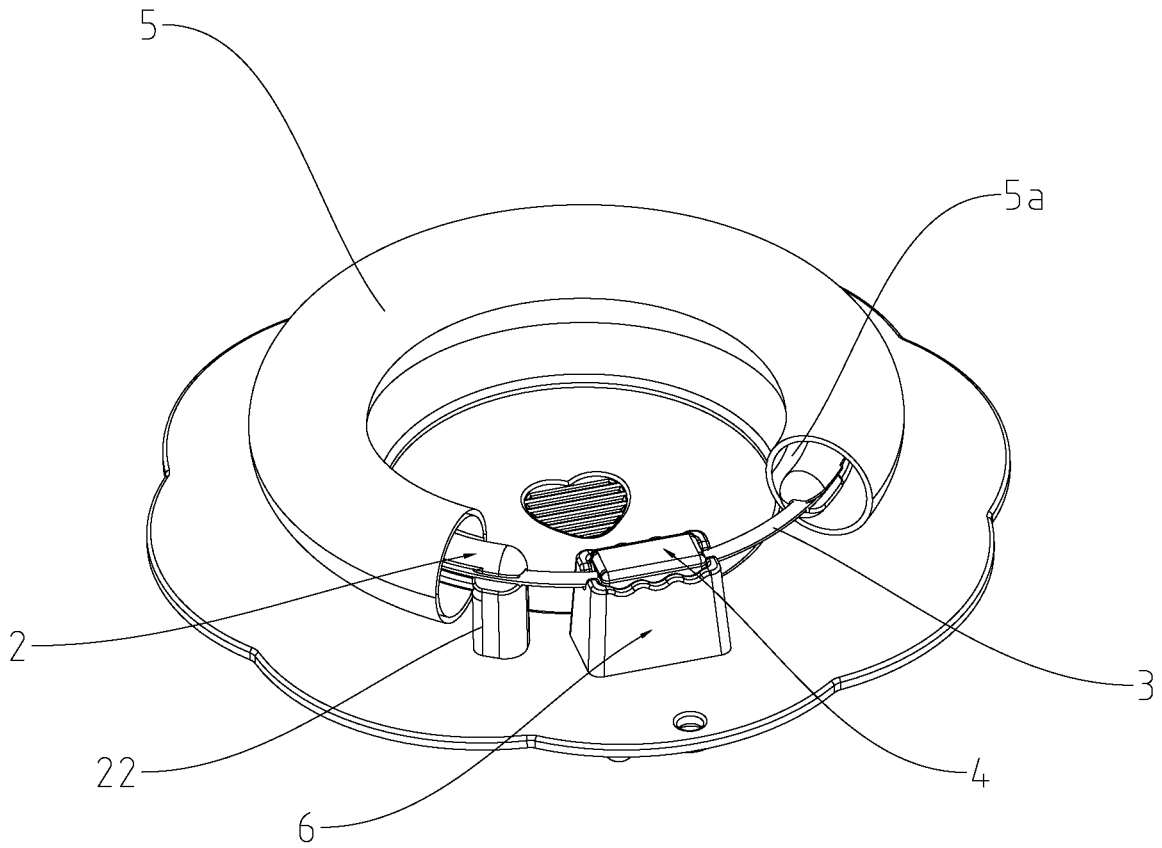
FIG. 5 is a schematic structural diagram of a decorative part in an embodiment of the present disclosure.
Figure 6:
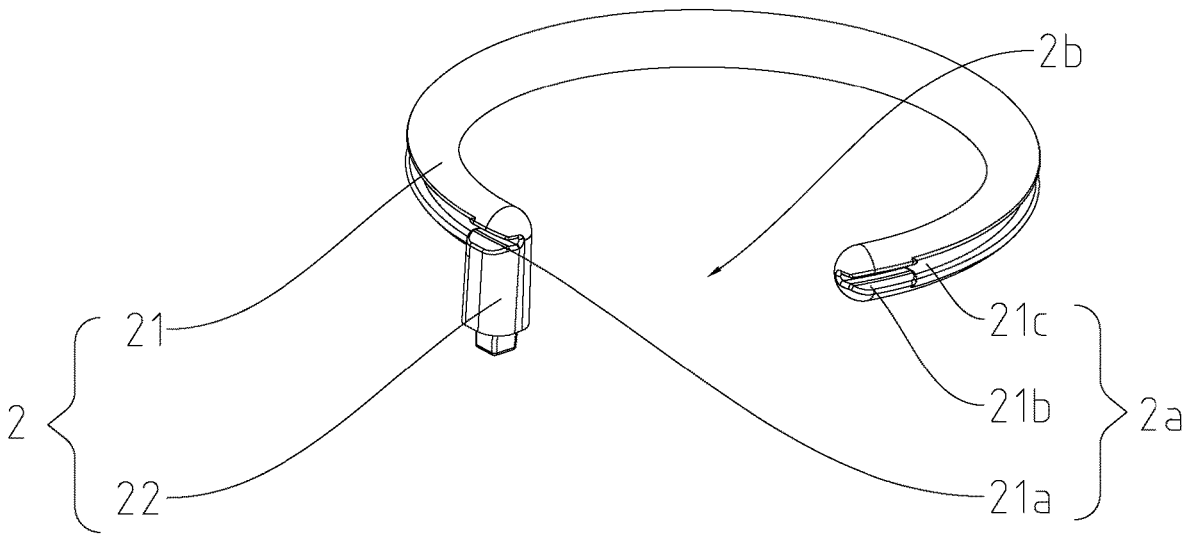
FIG. 6 is a schematic structural diagram of a main body in an embodiment of the present disclosure.

As shown in FIG. 5 and FIG. 6, the decorative part 5 is provided with a decorative hole 5*a*. The decorative hole 5*a* extends along a second portion 21*b* through a first portion 21*a* of the main body 2 and sleeves the elastic member 3. Before the first state, the decorative part 5 sleeves the elastic member 3 or the main body 2. When the elastic member 3 is in the second state, the elastic member 3 and the connection assembly 4 are taken out, thus obtaining a hair band. This not only improves the operational ability of a user, but also beautifies the overall appearance of the product.

In some embodiments, a material of the decorative part 5 is lace, silk, fur, or cloth.

In some embodiments, a cross-sectional area of the first channel 41*a* is smaller than a cross-sectional area of the limiting slot 41*c*; a cross-sectional area of the second channel 41*b* is smaller than the cross-sectional area of the limiting slot 41*c*; two ends of the main body 2 define a gap 2*b*; the first cover body 41 is correspondingly arranged at the gap 2*b*; the main body 2 further includes a supporting member 22, and one end of the main body 2 is connected to the load-bearing surface 121 through the supporting member 22; the toy for making the bind-up member further includes a supporting seat 6 arranged on the load-bearing surface 121; a mounting slot 6*a* is arranged on the supporting seat 6; and the first cover body 41 is detachably mounted in the mounting slot 6*a*.

As shown in FIG. 2 to FIG. 3, the cross-sectional area of the first channel 41*a* and the cross-sectional area of the second channel 41*b* are both smaller than the cross-sectional area of the limiting slot 41*c*. This is to facilitate the clamping of the first end portion 31 and the second end portion 32 of the elastic member 3, and prevent retraction due to the elasticity of the elastic member 3.

As shown in FIG. 3 and FIG. 6, the gap 2*b* or an operation space is defined by the two ends of the main body 2, and the first cover body 41 is arranged at the gap 2*b* or the operation space. By the arrangement of this position, it is convenient for a user to mount the two end portions of the elastic member 3 in the connection assembly 4, which can save the mounting time.

As shown in FIG. 1 and FIG. 6, one end of the supporting member 22 is connected to the load-bearing surface 121, and the other end is connected to the main body 2. This is to fix the main body 2 and improve the stability of the main body 2 during operation.

As shown in FIG. 1 to FIG. 6, one end of the supporting seat 6 is connected to the load-bearing surface 121, and the other end is detachably mounted on the first cover body 41. A mounting slot 6*a*, a second channel 41*b*, and a third channel 6*b* are provided on a top surface of the supporting seat 6. The mounting slot 6*a*, the second channel 41*b*, and the third channel 6*b* are interpenetrated. An arc-shaped wave surface is provided on the top surface of the supporting seat 6. The arc-shaped wave surface is configured to facilitate the arrangement of the connection assembly 4. The mounting slot 6*a* is configured to fix the connection assembly 4, so that when the elastic member 3 is operated to cooperate with the connection assembly 4, the connection assembly 4 will not deviate due to the elastic retraction of the elastic member 3.

In some embodiments, the limiting structure 2*a* is constructed as a groove provided on the outer circumferential wall of the main body 2.

As shown in FIG. 6, the limiting structure 2*a* is a groove that is configured to guide and limit the elastic member 3.

In some embodiments, the limiting structure 2*a* extends from one end of the main body 2 to the other end of the main body 2 along the outer circumferential wall of the main body 2.

As shown in FIG. 6, the limiting structure 2*a* extends from the first portion 21*a* of the outer circumferential wall of the main body 2 to the second portion 21*b*, to achieve a guide effect.

In some embodiments, the limiting structure 2*a* includes a first portion 21*a* located at one end of the main body, a second portion 21*b* located at the other end of the main body, and a third portion 21*c* connected to the first portion 21*a* and the second portion 21*b*. A cross-sectional area of the first portion 21*a* and a cross-sectional area of the second portion 21*b* are both smaller than a cross-sectional area of the third portion 21*c*.

As shown in FIG. 2 and FIG. 6, the limiting structure 2*a* includes the first portion 21*a*, the second portion 21*b*, and the third portion 21*c*. The first portion 21*a* and the second portion 21*b* are connected to the third portion 21*c*. The cross-sectional area of the first portion 21*a* and the cross-sectional area of the second portion 21*b* are both smaller than that of the third portion 21*c*. It can be understood that the first portion 21*a* and the second portion 21*b* can be protrusions, and the first end portion 31 and the second end portion 32 are respectively clamped to the first portion 21*a* and the second portion 21*b*. This is to restrict the extension and retraction of the elastic member 3 due to its elasticity.

In some embodiments, the seat body 1 includes: a shell 11, provided with an accommodating chamber 11*a* and a mounting opening 11*b* communicated to the accommodating chamber 11*a*; a load-bearing member 12, covering the mounting opening 11*b*, wherein a surface of one side of the load-bearing member 12 facing away from the accommodating chamber 11*a* is the load-bearing surface 121; the load-bearing member 12 is provided with a sound hole 12*a*; and a sound production unit 71, a power supply 74, a light emitting unit 72, and a control unit 73 which are all arranged in the accommodating chamber 11*a*, wherein the control unit 73 is electrically connected to the sound production unit 71, the light emitting unit 72, and the power supply 74, respectively.

Figure 7:
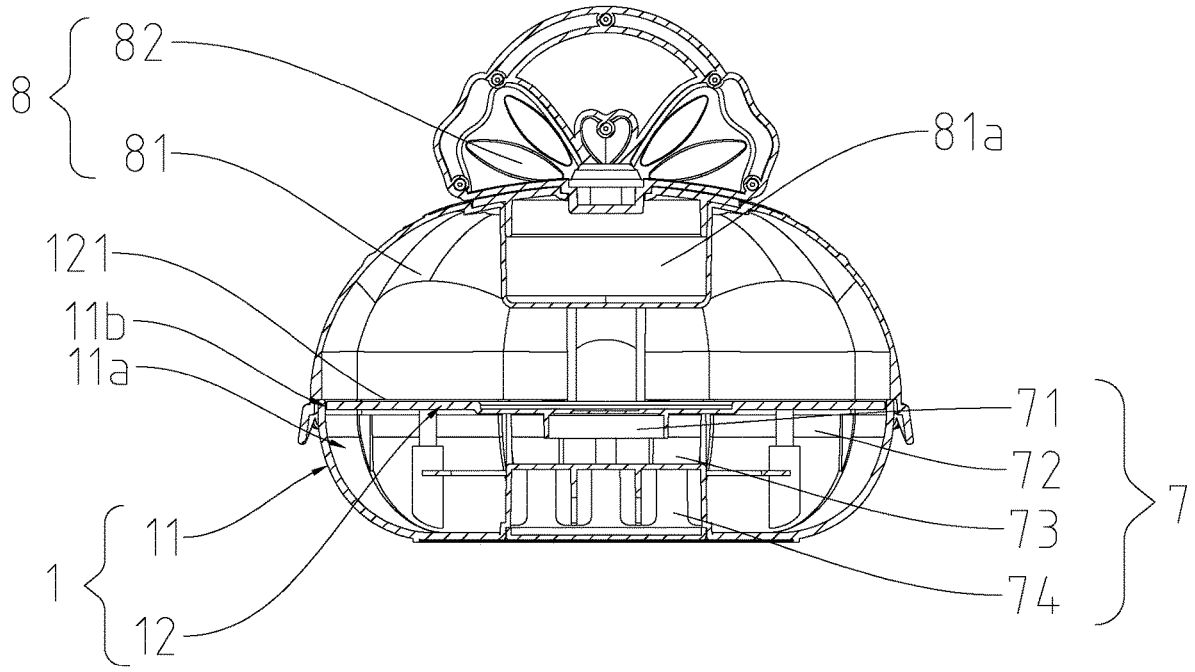
FIG. 7 is a sectional diagram of a toy according to an embodiment of the present disclosure.

As shown in FIG. 1 and FIG. 7, the seat body 1 includes the shell 11 and the load-bearing member 12. The shell 11 is provided with an accommodating chamber 11*a* and a mounting opening 11*b*; the load-bearing member 12 covers the mounting opening 11*b*; the load-bearing surface 121 is arranged on a top surface of the load-bearing member 12; the load-bearing surface 121 is provided with a switching portion 9; and the load-bearing member 12 is provided with the sound hole 12*a*. The toy for making a bind-up member further includes a control system 7. The control system 7 includes a sound production unit 71, a light emitting unit 72, a control unit 73, and a power supply 74. The sound production unit 71 is arranged on a bottom side of the sound hole 12*a*, and the control unit 73 is electrically connected to the sound production unit 71, the light emitting unit 72, and the power supply 74 respectively and is arranged in the accommodating chamber 11*a*. The sound production unit 71 is a speaker or a horn; the light emitting unit 72 is a light-emitting diode (LED) lamp or a light strip; and the control unit 73 is a circuit board.

In some embodiments, the toy for making the bind-up member further includes a cover 8; the cover 8 is rotatably connected to the seat body 1; and the cover 8 can cover the load-bearing surface 121.

Figure 8:
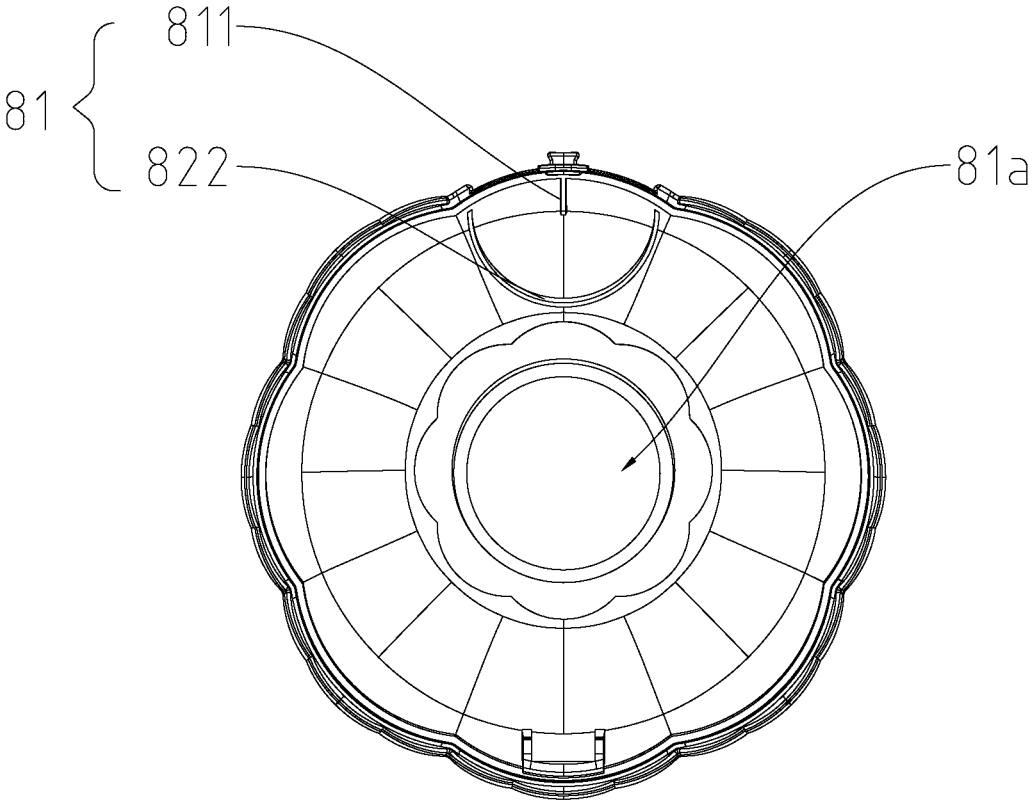
FIG. 8 is a schematic structural diagram of a cover in an embodiment of the present disclosure.

As shown in FIG. 7 and FIG. 8, the toy for making the bind-up member further includes the cover 8. The cover 8 is rotatably connected to the seat body 1. The cover 8 can cover the load-bearing surface 121 to prevent dust from entering the seat body 1.

In some embodiments, the cover 8 includes a cover main body 81 rotatably connected to the seat body 1 and capable of covering the load-bearing surface 121, and a handle 82 detachably connected to the cover main body 81.

As shown in FIG. 1 to FIG. 8, the cover 8 includes the cover main body 81 and the handle 82. The cover main body 81 is rotatably connected to the seat body 1, and the handle 82 is detachably connected to the cover main body 81. The cover main body 81 is provided with a storage chamber 81*a*, and the handle 82 covers the storage chamber 81*a*. A first contact portion 811 and a second contact portion 822 are arranged on one side of the cover main body 81 along the storage chamber 81*a*. The first contact portion 811 is configured to control the switching portion 9, and the second contact portion 822 is configured to buckle the cover 8. By generation of a downward force, when the second contact portion 822 presses against a top surface of the second cover body 42 due to the force, the first cover body 41 and the second cover body 42 can be in tight fit.

In summary, a first manner is as follows: the toy for making the bind-up member provided in the embodiments of the present disclosure includes the seat body 1, the main body 2, the elastic member 3, and the connection assembly 4. The main body 2 is arranged on the seat body 1; the main body 2 is shaped like the non-closed ring 21, and the limiting structure 2*a* is arranged on the outer circumferential wall; the elastic member 3 is arranged around the outer circumferential wall of the main body 2 by means of the limiting structure 2*a*; the two end portions of the elastic member 3 are arranged at the connection assembly 4 through the limiting structure 2*a*; the connection assembly 4 is detachably connected to the seat body 1; the cover 8 covers the seat body 1; the contact portion 811 is configured to control the switching portion 9, so that the sound production unit 71, the light emitting unit 72, the control unit 73, and the power supply 74 to be turned on or turned off; and the cover 8 generates the downward force. In this way, when the second contact portion 822 presses against the top surface of the second cover body 42 due to the force, the first cover body 41 and the second cover body 42 can be in tight fit. When the cover 8 is opened, the first contact portion 811 is separated from the switching portion 9, the sound production unit 71, the light emitting unit 72, the control unit 73, and the power supply 74 are turned on or turned off. When the connection assembly 4 is separated from the supporting seat 6, the elastic member 3 can be connected to the connection assembly 4 to form a bind-up ringlike structural member, which reduces the waste of resources or avoids that a tie body cannot be used.

According to the embodiments of the present disclosure, a difference between another manner and the first manner is as follows: The toy for making the bind-up member includes the decorative part 5. The decorative part 5 is provided with a decorative hole 5*a*. The decorative hole 5*a* extends along the second portion 21*b* through the first portion 21*a* of the main body 2 and sleeves the elastic member 3. Before the first state, the decorative part 5 sleeves the elastic member 3 or the main body 2. When the elastic member 3 is in the second state, the elastic member 3 and the connection assembly 4 are taken out, thus obtaining a hair band. This not only improves the operational ability of a user, but also beautifies the overall appearance of the product.

All the technical features of the above embodiments can be combined randomly. For the sake of brevity, all possible combinations of all the technical features in the above embodiments are not described. However, these technical features shall all be considered to fall within the scope of this specification as long as there is no contradiction in their combinations.

It can be understood that the above use modes are only an example, and an operator can use any mode according to a specific use need. This will not be specifically limited here.

The foregoing embodiments merely express several implementations of the present disclosure. The descriptions thereof are relatively specific and detailed, but are not understood as limitations on the scope of the patent. A person of ordinary skill in the art can also make several transformations and improvements without departing from the idea of the present application. These transformations and improvements fall within the protection scope of the present application. Therefore, the protection scope of this patent shall be subject to the appended claims.

What is claimed is:

1. A toy for making a bind-up member, comprising:

a seat body, provided with a load-bearing surface;

a main body, shaped like a non-closed ring, wherein the main body is suspended on the load-bearing surface, and a limiting structure is arranged on an outer circumferential wall of the main body;

an elastic member, arranged around the outer circumferential wall of the main body by means of the limiting structure, wherein the elastic member is provided with a first end portion that extends from a first end of the main body, and a second portion that extends from a second end of the main body; and a connection assembly, comprising a first cover body that is detachably mounted on the load-bearing surface, and a second cover body that is detachably connected to the first cover body, wherein the first cover body is provided with a limiting slot, a first channel, and a second channel; the first channel penetrates through one side wall of the limiting slot and is communicated to the limiting slot; the second channel penetrates through another side wall of the limiting slot and is communicated to the limiting slot;

the connection assembly has a first state in which the first cover body and the second cover body are separated, and a second state in which the first cover body and the second cover body are connected;

in the first state, the first end portion enters the limiting slot via the first channel, and the second end portion enters the limiting slot via the second channel; in the second state, the second cover body covers a notch of the limiting slot; and both the first end portion and the second end portion are limited between the first cover body and the second cover body.

2. The toy for making the bind-up member according to claim 1, wherein the toy further comprises a decorative part, and the decorative part sleeves the elastic member.

3. The toy for making the bind-up member according to claim 2, wherein a material of the decorative part is lace, silk, fur, or cloth.

4. The toy for making a bind-up member according to claim 1, wherein a cross-sectional area of the first channel is smaller than a cross-sectional area of the limiting slot; a cross-sectional area of the second channel is smaller than the cross-sectional area of the limiting slot;

the first end and the second end of the main body define a gap; the first cover body is correspondingly arranged at the gap;

the main body further comprises a supporting member, and the first end of the main body is connected to the load-bearing surface through the supporting member;

the toy further comprises a supporting seat arranged on the load-bearing surface; a mounting slot is arranged on the supporting seat; and the first cover body is detachably mounted in the mounting slot.

5. The toy for making the bind-up member according to claim 1, wherein the limiting structure is constructed as a groove provided on the outer circumferential wall of the main body.

6. The toy for making the bind-up member according to claim 5, wherein the limiting structure extends from the first end of the main body to the second end of the main body along the outer circumferential wall of the main body.

7. The toy for making the bind-up member according to claim 6, wherein the limiting structure comprises a first portion located at the first end of the main body, a second portion located at the second end of the main body, and a third portion connected to the first portion and the second portion; and a cross-sectional area of the first portion and a cross-sectional area of the second portion are both smaller than a cross-sectional area of the third portion.

8. The toy for making the bind-up member according to claim 1, wherein the seat body comprises:

a shell, provided with an accommodating chamber and a mounting opening communicated to the accommodating chamber;

a load-bearing member, covering the mounting opening, wherein a surface of one side of the load-bearing member facing away from the accommodating chamber is the load-bearing surface; the load-bearing member is provided with a sound hole; and a sound production unit, a power supply, a light emitting unit, and a control unit which are all arranged in the accommodating chamber, wherein the control unit is electrically connected to the sound production unit, the light emitting unit, and the power supply, respectively.

9. The toy for making the bind-up member according to claim 1, wherein the toy further comprises a cover; the cover is rotatably connected to the seat body; and the cover covers the load-bearing surface.

10. The toy for making the bind-up member according to claim 9, wherein the cover comprises a cover main body rotatably connected to the seat body and capable of covering the load-bearing surface, and a handle detachably connected to the cover main body.

* * * * *